United States Patent [19]

Kumagai et al.

[11] 4,284,054

[45] Aug. 18, 1981

[54] LEAN AIR-FUEL MIXTURE ATTRACTION METHOD AND ATTRACTION ELECTRODE PLUG IN ENGINE

[75] Inventors: Seiichiro Kumagai, Koishikawa; Michio Abe, Kasugai Aichi; Naoyuki Maeda, Inuyama, all of Japan

[73] Assignee: Tokai TRW & Co. Ltd., Aichi, Japan

[21] Appl. No.: 57,384

[22] Filed: Jul. 23, 1979

[51] Int. Cl.[3] ..... F02B 33/00

[52] U.S. Cl. ..... 123/536

[58] Field of Search ..... 123/536, 537, 538, 260

[56] References Cited

U.S. PATENT DOCUMENTS

| | | | |
|---|---|---|---|
| 1,376,180 | 4/1921 | Wickersham | 123/538 |
| 3,318,293 | 5/1967 | Hickling et al. . | |
| 3,841,824 | 10/1974 | Bethel | 123/536 |
| 3,842,818 | 10/1974 | Cowell et al. . | |
| 4,020,388 | 4/1977 | Pratt, Jr. . | |
| 4,041,922 | 8/1977 | Abe et al. . | |
| 4,065,919 | 1/1978 | Eknayan | 123/536 |
| 4,071,800 | 1/1978 | Atkins . | |
| 4,124,003 | 11/1978 | Abe | 123/536 |

*Primary Examiner*—Ronald H. Lazarus
*Attorney, Agent, or Firm*—Yount & Tarolli

[57] ABSTRACT

An improved apparatus for igniting a lien air-fuel mixture includes a spark plug having a straight longitudinally extending main electrode and a side electrode disposed adjacent to and electrically insulated from the main electrode.

An attraction plug is mounted in the cylinder head at a location offset to one side of and adjacent to the spark plug. The attraction plug includes a straight longitudinally extending central electrode and an insulator which at least partially encases the central electrode for electrically insulating the central electrode and for isolating the portion of the central electrode disposed in the combustion chamber from the atmosphere in the combustion chamber. The central electrode has a longitudinal axis which extends transversely to the longitudinal axis of the main electrode of the spark plug. In addition, the central electrode has an end portion which is disposed adjacent to the main electrode of the spark plug. An electrical potential is applied to the central electrode of the attraction plug to establish an electrostatic field in the combustion chamber without establishing a corona discharge in the combustion chamber. In addition, an electrical potential is applied to the main electrode to establish a spark between the main and the side electrode to ignite fuel particles attracted to the vicinity of the spark plug by the electrostatic field from the attraction plug.

1 Claim, 13 Drawing Figures

LEAN AIR-FUEL MIXTURE ATTRACTION METHOD AND ATTRACTION ELECTRODE PLUG IN ENGINE

BACKGROUND OF THE INVENTION

This invention relates to an attraction method for lean air-fuel mixture to be supplied to the combustion chamber in a cylinder and an attraction electrode plug for use in the attraction method.

One prior art method for collecting fuel particles in a lean air-fuel mixture to be supplied to the combustion chamber in a cylinder and igniting the lean air-fuel mixture is designed to cause corona discharge by means of a corona discharge electrode 90 to collect the fuel particles and ignites the lean air-fuel mixture as shown in FIG. 1.

However, in the prior art method, since a negative pressure generates in the cylinder on the suction stroke of the engine, the corona discharge electrode 90 tends to cause glow discharge and the high voltage applied to the corona discharge electrode 90 drops suddenly as shown in FIG. 2 and is not capable of maintaining the fuel particles at and about the spark gap 22 of the ignition plug 20 resulting sometimes in failure of ignition.

The present invention is designed to eliminate the disadvantages inherent in the prior art method as mentioned hereinabove and provide an attraction method for lean air-fuel mixture in which the fuel particles in the lean air-fuel mixture are always attracted to and about the spark gap of the ignition plug and maintained there until the time of ignition to the degree that the combustion of the fuel can be positively effected, an attraction electrode capable of attracting the fuel particles in the lean air-fuel mixture by electrostatic induction and an attraction method for lean air-fuel mixture disposed in such a manner that the distribution of the fuel particles which flow into manifolds in communication with cylinders can be made evenly to the respective cylinders.

The construction and operation of the present invention will now be described referring to the accompanying drawings.

DESCRIPTION OF A PREFERRED EMBODIMENT OF THE INVENTION

Figure 1:
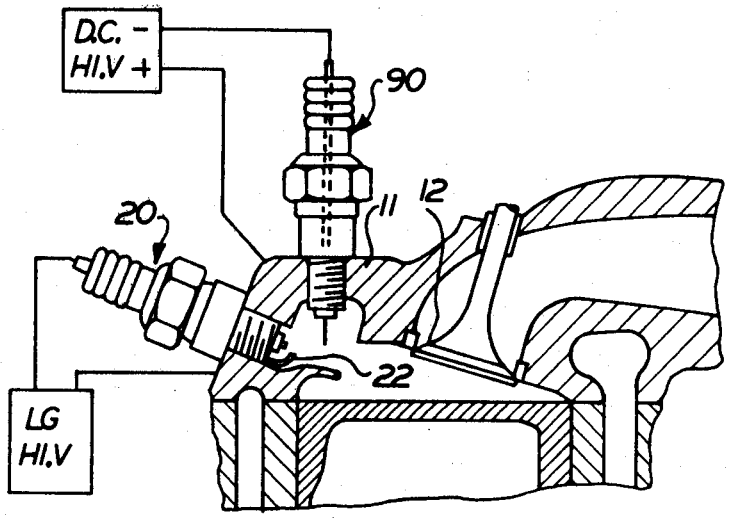
FIG. 1 PRIOR ART
FIG. 1 is an explanatory view of a prior art lean air-fuel mixture attraction method employing corona discharge electrode plugs.
Figure 2:
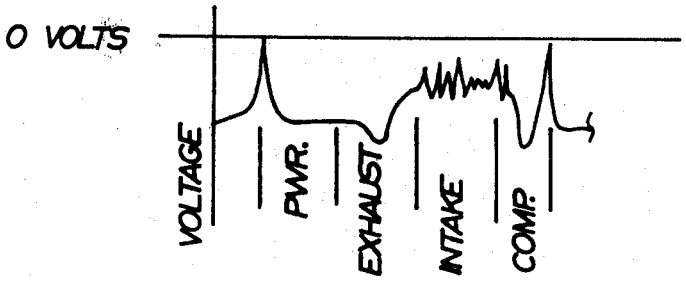
FIG. 2 PRIOR ART
FIG. 2 is a view showing the relationship between the strokes in an engine utilizing the prior art method shown in FIG. 1 and the voltage within the combustion chamber.
Figure 3:
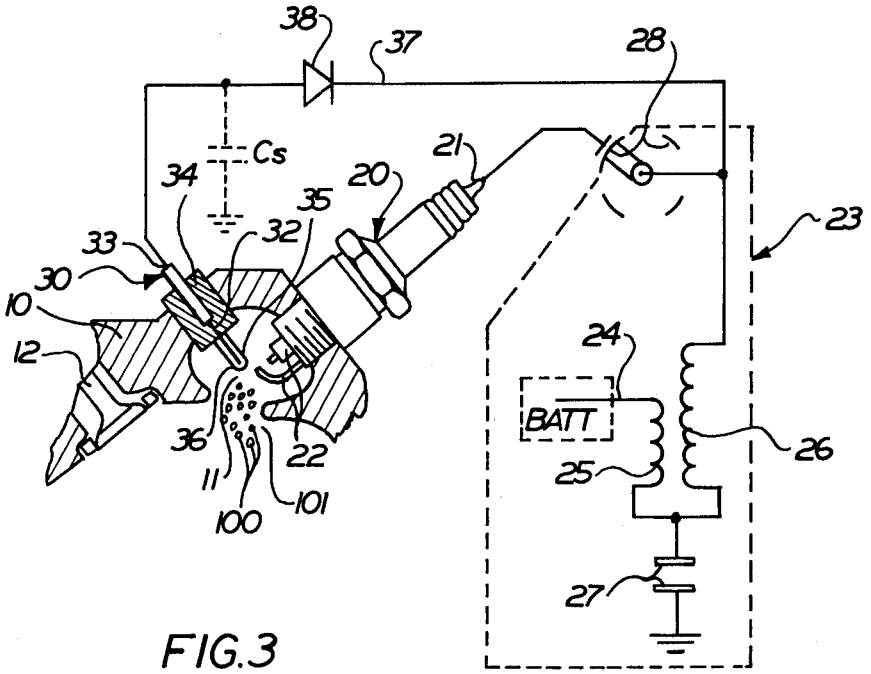
FIG. 3 is a view showing one embodiment of the lean air-fuel mixture attraction method by the present invention.

FIG. 3 shows one embodiment of the lean air-fuel mixture attraction method according to the present invention and as shown in this figure, a combustion chamber 11 defined in the cylinder head 10 is provided with an ignition plug 20 and an attraction electrode plug 30 with the leading end 35 of the center electrode 32 of the attraction electrode plug 30 positioned adjacent to the spark gap 22 of the ignition plug 20. The leading end 35 of the center electrode 32 has an electrostatic induction means 36 surrounding the leading end.

The ignition plug 20 is electrically connected to an ignition circuit 23 through a terminal 21 provided at the end of the plug remote from the spark gap 22 and the ignition circuit is conventional and includes a battery 24, a primary coil 25, a secondary coil 26, a contact 27 and a distributor 28. The ignition circuit 23 is regulated to work for ignition when fuel particles 100 are attracted and accumulated at and about the spark gap 23 to form an ignitable lean air-fuel mixture layer 101 there.

The attraction electrode plug 30 comprises a metal main body 31 (FIG. 6) through which the center electrode 32 extends and one end or the outer end 33 of the center electrode 32 is electrically connected to a high voltage application circuit 37 and the other or inner end 35 of the center electrode has the electrostatic induction means 36 thereon. An intermediate portion of the center electrode 32 between the opposite ends is surrounded and supported by an electrical insulator 34. In one embodiment, the elecrostatic induction means 36 comprises an electrical insulator surrounding the other end 35 of the center electrode 32. The high voltage application circuit 37 has a rectifier 38 and is directly and electrically connected to the secondary coil 26.

In the illustrated embodiment, when a high negative voltage or a peak voltage developing at the secondary coil 26 of the ignition coil 23 is smoothed by the rectifier 38 and a floating capacity ($C_s$) of the high voltage application circuit and applied to the center electrode 32 of the attraction electrode plug 30, an electric field is provided at or about the spark gap 22 of the ignition plug 22 through effect of the center electrode 32 which is positioned in the combustion chamber 11 whereby the fuel particles 100 in the lean air-fuel mixture supplied to the combustion chamber 11 through a suction valve 12 are attracted towards and accumulate about the inner end 35 of the center electrode 32. Thus, the fuel particles 100 are attracted toward and accumulated about the inner end 35 of the center electrode 32 having the electrostatic induction means 36 by the electrostatic induction action of the electric field maintained by the high voltage application until the fuel particles form the ignitable lean air-fuel mixture layer 101 about the spark gap 22 of the ignition plug 20.

When the ignitable lean air-fuel mixture layer 101 is formed about the spark gap 22 of the ignition plug 20, the ignitable lean air-fuel mixture is ignited by the ignition plug 20 through the ignition circuit 23 thereby causing the lean air-fuel mixture to explode.

Figure 4:
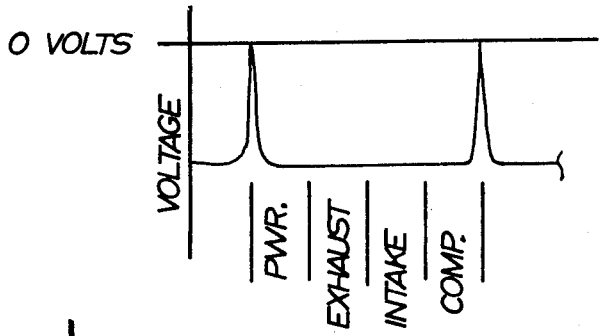
FIG 4 is a view showing the relationship between the engine strokes in an engine utilizing the present invention and the voltage within the combustion chamber.
Figure 5:
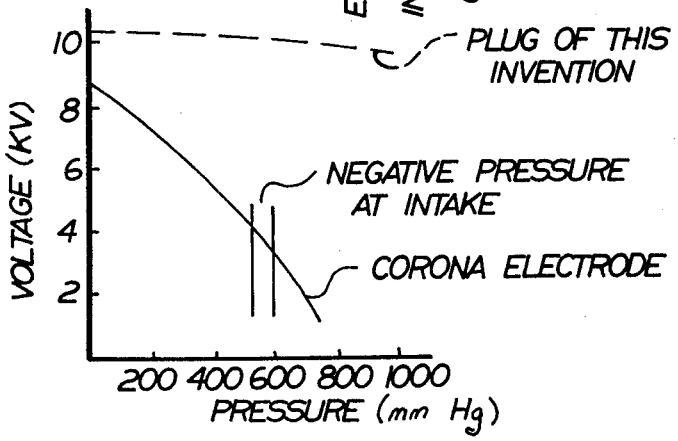
FIG. 5 is a performance comparison diagram of the prior art method and the method of the present invention.

In the illustrated embodiment, the fuel particles 100 in the lean air-fuel mixture are attracted and accumulated by the electrostatic induction action of the electric field provided by the attraction plug to thereby form the ignitable lean air-fuel mixture layer 101. Therefore, there is no sudden voltage drop phenomenon due to the transition from a corona discharge to a glow discharge in the fuel suction stage by negative pressure and thus, as more clearly shown in FIGS. 4 and 5, the vicinity of at least the inner end 35 of the attraction electrode plug is always maintained at a high voltage through the compression, suction, discharge and expansion strokes of the engine whereby the fuel particles 100 are attracted towards and held at and about the spark gap 22 of the ignition plug 20 until the lean air-fuel mixture within the combustion chamber 11 is ignited and thus, the lean air-fuel mixture can be positively exploded.

Figure 6:
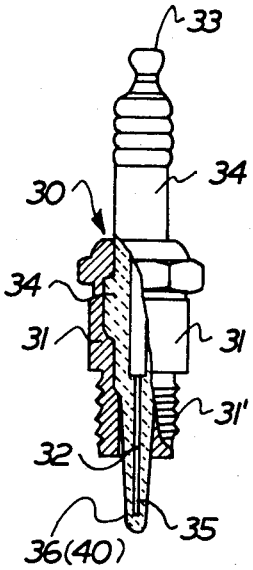
FIG. 6 is an elevational view in partial section of an embodiment of the attraction electrode plug of the present invention.

Referring to FIG. 6, a second embodiment of the attraction electrode plug of the invention is shown and the attraction electrode plug 30 comprises a metal main body 31 and a center electrode 32 which extends through the main body 31.

The outer periphery of the lower half portion of the metal main body 31 is formed with threads 31' by means of which the attraction electrode plug 30 is secured to the top wall of the combustion chamber of the cylinder head.

The center electrode 32 extends through the metal main body 31 with the opposite ends 33 and 35 thereof extending out of the main body 31.

One end 33 of the center electrode 32 is electrically connected to the high voltage application circuit and the intermediate portion of the center electrode 32 between the opposite ends thereof is surrounded by an electric insulator 34. The other end 35 of the center electrode 32 is surrounded by an electrostatic induction means 36 which is integral with another electric insulator 40.

The attraction electrode plug 30 is secured to the top wall of the combustion chamber in the cylinder head by inserting the end 35 surrounded by the electrostatic induction means 36 into the combustion chamber of the cylinder head and screwing the threaded portion 31' of the main body 31 into the top wall of the combustion chamber. When a high voltage is applied to the end 33 of the center electrode 32, an electric field is provided in the combustion chamber 11 as shown in FIG. 3 and the fuel particles 100 in the lean air-fuel mixture supplied to the combustion chamber 11 are attracted towards and accumulate at and about the end 35 of the center electrode 32 by the electrostatic induction action of the electric field.

Figure 7:
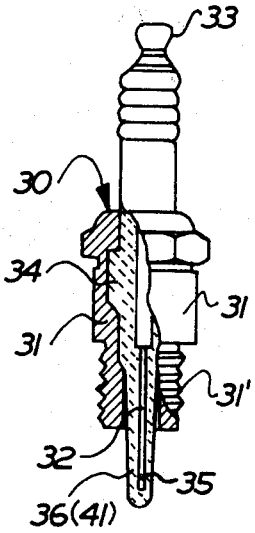

FIG. 7 shows another embodiment of the present invention and in this embodiment, the electrostatic induction means 36 includes an electrically conductive material 41 which surrounds the end 35 of the center electrode 32.

Figure 8:
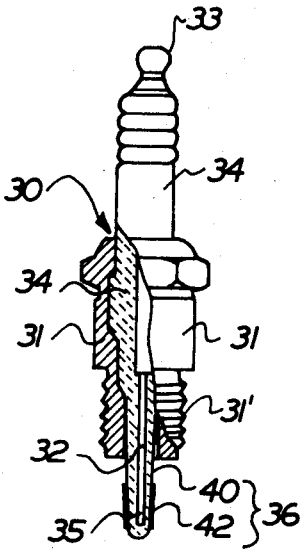
FIGS. 7, 8, and 9 are elevational views of other embodiments of the attraction electrode plugs of the present invention in partial section.

FIG. 8 shows another embodiment of the present invention and in this embodiment, the electrostatic induction means 36 includes a floating electrode 42 made of an electrically conductive material about the electric insulator 40 which surrounds the end 35 of the center electrode 32 and the other parts of this embodiment are substantially similar to the corresponding parts of the preceding embodiment shown in FIG. 6. The floating electrode 42 may be provided about the electrically conductive material 41 as shown in FIG. 7.

Figure 9:
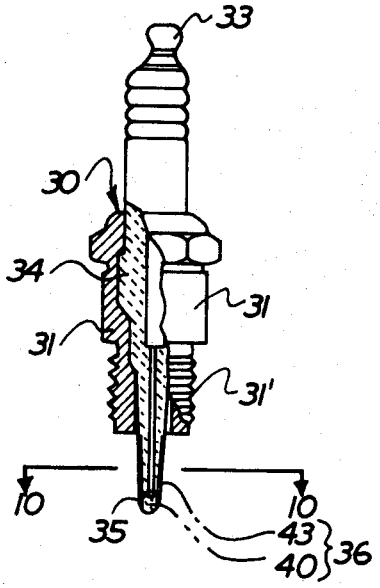
Figure 10:
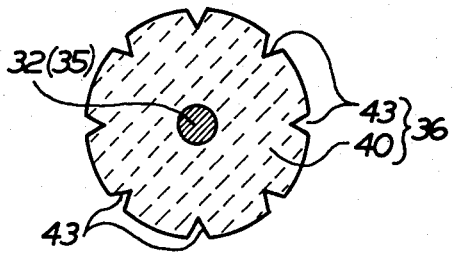
FIG. 10 is a crossectional view taken along the line 10—10 of FIG. 9.

FIGS. 9 and 10 show another embodiment of the present invention and in this embodiment, the electrostatic induction means 36 includes an electric insulator 40 surrounding the end 35 of the center electrode 32 and provided with grooves 43 for receiving fuel particles 100 and the other parts of this embodiment are substantially similar to the corresponding parts of the preceding embodiments. The grooves 43 may be provided in the outer periphery of the electrically conductive material 41 as shown in FIG. 7 or the grooves 43 may be replaced by a plurality of recesses of a suitable size.

Figure 11:
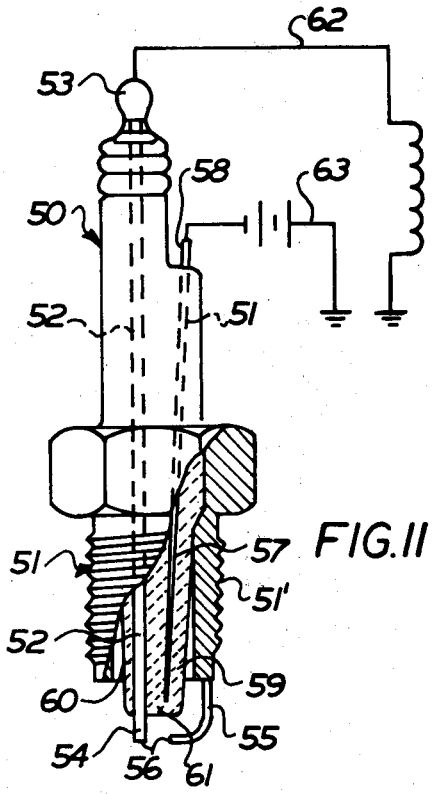
FIG. 11 is an elevational view of another embodiment of the attraction electrode of the present invention in partial section.

FIG. 11 shows another embodiment of the attraction electrode plug of the present invention and the attraction electrode plug 50 comprises a metal main body 51, a first center ignition electrode 52, an outer electrode 55 and a second electrostatic center electrode 57.

The outer periphery of one half portion of the metal main body 51 is provided with threads 51' and the attraction electrode plug 50 is secured to the combustion chamber of the cylinder head by screwing the threaded portion of the main body 51 into the top wall of the cylinder head combustion chamber.

The first electrode 52 and second electrode 57 are disposed within the metal main body 51 in a spaced relationship to each other and embedded in an electric insulator 60 positioned within the metal main body 51.

The first electrode 52 is electrically connected at one end 53 to an ignition circuit 62 and extends at the other end 54 beyond the adjacent end face of the electric insulator 60.

The outer electrode 55 projects beyond the adjacent end of the metal main body 51 and the leading or free end of the outer electrode 55 is bent towards the end 54 of the first electrode 52 to define a spark gap 56 by the end 54 of the first electrode 52 and the outer electrode 55.

The second electrode 57 is electrically connected at one end 58 to a high voltage application circuit 63 and the other end 59 of the second electrode 57 is positioned between the first electrode 52 and the outer electrode 55 and is formed with an electrostatic induction means 61 which is surrounded by the electrostatic insulator 60.

The attraction electrode plug 50 is mounted in the combustion chamber by positioning the spark gap 56 and the end 59 of the second electrode 57 which end is formed with the electrostatic induction means 61 within the combustion chamber. When a high voltage is applied to the second electrode 57, an electric field is formed about the end 59 of the second electrode 57 to attract and accumulate the fuel particles in the lean air-fuel mixture supplied to the combustion chamber towards and about the spark gap 56 by the electrostatic induction action. The accumulated fuel particles form an ignitable lean air-fuel mixture layer whereupon a voltage is applied to the spark gap 56 through the first electrode 52 to ignite the lean air-fuel mixture. Thus, the attraction electrode plug 50 has the dual functions of an inherent attraction electrode plug and an ignition plug.

Figure 12:
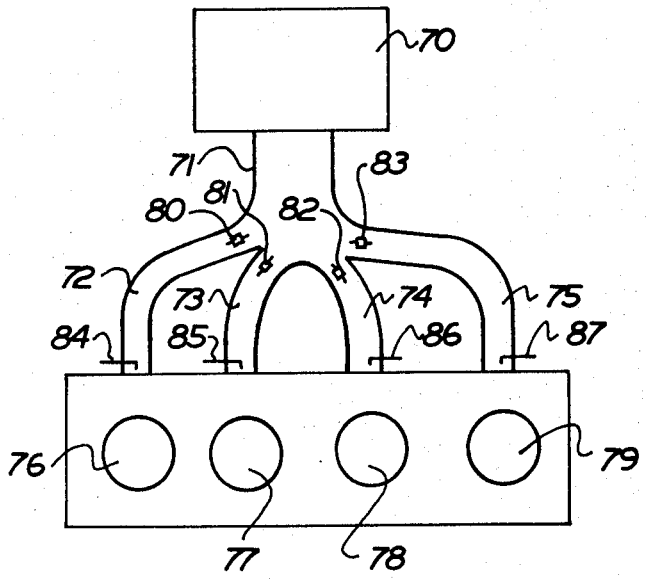
FIG. 12 is a view showing another embodiment of the lean air-fuel mixture attraction method of the present invention.

FIG. 12 shows another embodiment of the lean air-fuel mixture attraction method according to the present invention. The device for performing the attraction method generally comprises a carburetor 70, a main lean air-fuel mixture passage 71, manifolds 72, 73, 74, 75 and cylinders 76, 77, 78 and 79 connected to the carburetor 70 through the main lean air-fuel mixture passage 71 and manifolds 72, 73, 74, 75, respectively. Attraction electrode plugs 80, 81, 82, 83 are provided in the manifolds 72, 73, 74, 75, respectively in the upper streams of these manifolds and fuel concentration measuring means 84, 85, 86, 87 are provided in the downstreams of the manifolds within the manifolds.

The attraction electrode plugs 80, 81, 82, 83 serve to positively attract the fuel particles in the lean air-fuel mixture distributed into the manifolds 72, 73, 74, 75, respectively and also feed the fuel particles through the manifolds along the axes of the manifolds.

The concentration measuring means 84, 85, 86, 87 measure the concentration of the lean air-fuel mixture within the manifolds 72, 73, 74, 75 and based on the measuring results, the voltage to be applied to the attraction electrode plugs 80, 81, 82, 83 is controlled in inverse proportion to the concentration to thereby control the distribution amount of the lean air-fuel mixture to be attracted to the manifolds 72, 73, 74, 75.

According to the present invention, since the voltage applied to the attraction electrode plugs 80, 81, 82, 83 is controlled by the concentration of the lean air-fuel mixture to be fed to the manifolds 72, 73, 74, 75 and the attraction function of the attraction electrode plugs 80, 81, 82, 83 is controlled, the amount of the lean air-fuel mixture to be fed to the cylinders 76, 77, 78, 79 is adjusted whereby the concentration of the lean air-fuel mixture is made uniform and the lean air-fuel mixture is guided along the axes of the manifolds 72, 73, 74, 75 and the lean air-fuel mixture is prevented from adhering to the inner surfaces of the manifold walls.

Figure 13:
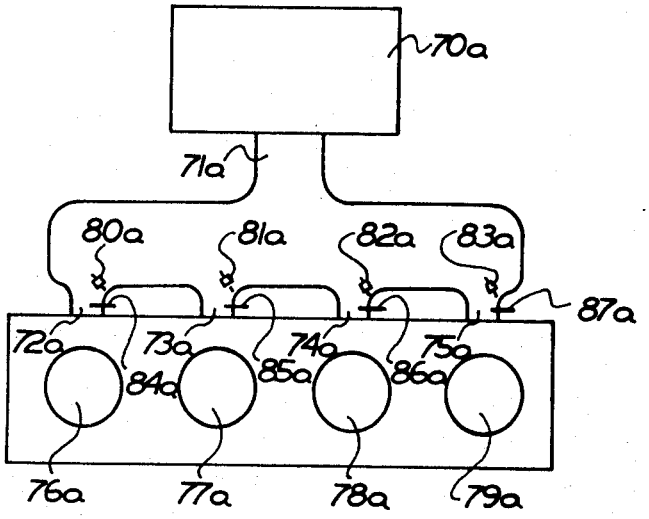
FIG. 13 is a view of still another embodiment of the invention.

FIG. 13 shows still another embodiment of the lean air-fuel mixture attraction method according to the present invention. The device of FIG. 13 is substantially the same as the device of FIG. 12. However, the device of FIG. 13 is preferred, in certain situations at least, since the attraction electrode plugs and measuring means are closer to the cylinders. The device for performing the attraction method generally comprises a carburetor 70*a*, a main lean air-fuel mixture passage 71*a*, relatively short manifolds 72*a*, 73*a*, 74*a*, 75*a* and cylinders 76*a*, 77*a*, 78*a*, 79*a* connected to the carburetor 70*a* through the main lean air-fuel mixture passage 71*a* and manifolds 72*a*, 73*a*, 74*a*, 75*a*, respectively. Attraction electrode plugs 80*a*, 81*a*, 82*a*, 83*a* are provided in the manifolds 72*a*, 73*a*, 74*a*, 75*a*, respectively in the upper streams of these manifolds and fuel concentration measuring means 84*a*, 85*a*, 86*a*, 87*a* are provided in the downstreams of the manifolds within the manifolds.

The attraction electrode plugs 80*a*, 81*a*, 82*a*, 83*a* serve to positively attract the fuel particles in the lean air-fuel mixture distributed into the manifolds 72*a*, 73*a*, 74*a*, 75*a*, respectively and also feed the fuel particles through the manifolds along the axes of the manifolds.

The concentration measuring means 84*a*, 85*a*, 86*a*, 87*a* measure the concentration of the lean air-fuel mixture within the manifolds 72*a*, 73*a*, 74*a*, 75*a* and based on the measuring results, the voltage to be applied to the attraction electrode plugs 80*a*, 81*a*, 82*a*, 83*a* is controlled in inverse proportion to the concentration to thereby control the distribution amount of the lean air-fuel mixture to be attracted to the manifolds 72*a*, 73*a*, 74*a*, 75*a*.

According to the present invention, since the voltage applied to the attraction electrode plugs 80*a*, 81*a*, 82*a*, 83*a* is controlled by the concentration of the lean air-fuel mixture to be fed to the manifolds 72*a*, 73*a*, 74*a*, 75*a* and the attraction function of the attraction electrode plugs 80*a*, 81*a*, 82*a*, 83*a* is controlled, the amount of the lean air-fuel mixture to be fed to the cylinders 76*a*, 77*a*, 78*a*, 79*a* is adjusted whereby the concentration of the lean air-fuel mixture is made uniform and the lean air-fuel mixture is guided along the axes of the manifolds 72*a*, 73*a*, 74*a*, 75*a* and the lean air-fuel mixture is prevented from adhering to the inner surfaces of the manifold walls.

With the above-mentioned construction and function of the attraction electrode plugs of the present invention, by the first embodiment of the attraction electrode plug, a uniform electric field is always provided (an electrostatic field is provided even in the negative pressure suction stroke) at or about the spark gap in the combustion chamber, and since the electric field attracts and accumulates the fuel particles in the lean air-fuel mixture by the electrostatic induction action and the lean air-fuel mixture is ignited only after an ignitable lean air-fuel mixture layer has been formed at and about the spark gap of the ignition plug, there are no disadvantages as seen in the prior art lean air-fuel mixture ignition methods such as sudded drop in voltage to be applied to the corona discharge electrode plug in the transit from corona discharge to glow discharge resulting in insufficient attraction of fuel particles leading to insufficient ignition. The present invention can positively perform the attraction and accumulation of the fuel particles in the lean air-fuel mixture, the drawing of the fuel particles and the ignition of the lean air-fuel mixture.

In the second embodiment of the invention, since the end of the center electrode positioned in the combustion chamber is formed with the electrostatic induction means to which a voltage higher than that applied to the prior art electrode is applied, the electric field attracts and accumulates the fuel particles in the lean air-fuel mixture into the combustion chamber and maintains the accumulated fuel particles in their attracted condition and thus the fuel particle attraction method as mentioned hereinabove can be perfectly performed.

In the third embodiment of the present invention, since the single metal main body includes the first electrode and the outer electrode forming the spark gap with the second electrode forming the attraction electrode plug, the single electrode assembly concurrently performs as the ignition plug and attraction electrode plug.

In the fourth embodiment of the present invention, the attraction electrode plugs are disposed adjacent to the connection between the main lean air-fuel mixture passage and the manifolds in the upper streams within the manifolds and the voltage applied to the attraction electrode plug is controlled so as to make the concentration of the lean air-fuel mixture uniform to thereby adjust the amount of the lean air-fuel mixture fed to the cylinders and equalize the concentration of the lean air-fuel mixture. And the fuel particles in the lean air-fuel mixture supplied to the manifolds are fed along the axes of the manifolds by the attraction action of the attraction electrode plugs whereby adhering of the fuel particles to the walls of the manifolds can be prevented.

Having described a specific preferred embodiment of the invention, the following is claimed:

1. An apparatus for igniting a lean air-fuel mixture, said apparatus comprising means for defining a combustion chamber, said means for defining a combustion chamber including a cylinder head, a spark plug mounted in said cylinder head, said spark plug including a straight longitudinally extending main electrode extending into the combustion chamber and exposed to the atmosphere in the combustion chamber and a side electrode disposed adjacent to said main electrode and electrically, insulated from said main electrode, an attraction plug mounted in said cylinder head at a location offset to one side of and adjacent to said spark plug, said attraction plug including a straight longitudinally extending central electrode, a metal body connected with said cylinder head, and insulator means at least partially encasing said central electrode for electrically insulating said central electrode from said metal body and said cylinder head and for isolating the portion of said central electrode disposed in the combustion chamber from the atomsphere in the combustion chamber, said central electrode of said attraction plug having a longitudinal central axis extending transversely to the longitudinal central axis of said main electrode of said spark plug and an end portion which is disposed adjacent to said main electrode and is encased by said insulator means, means for applying an electrical potential to said central electrode of said attraction plug to establish an electrostatic field in the combustion chamber to attract fuel particles to the vicinity of the end portion of said central electrode of said attraction plug and to a gap between said main and side electrodes of said spark plug without establishing a corona discharge in the combustion chamber, and means for applying an electrical potential to said main electrode of said spark plug to establish a spark between said main and side electrodes to ignite fuel particles attracted to the vicinity of said spark plug by the electrostatic field from said attraction plug.

* * * * *